US005927695A

United States Patent [19]

Eady

[11] Patent Number: 5,927,695

[45] Date of Patent: Jul. 27, 1999

[54] BED COIL SPRING UNIT AND METHOD OF MAKING SAME

[76] Inventor: Donald G. Eady, 4347 Erwin Drive, West Vancouver, British Columbia, Canada, V7P 1H7

[21] Appl. No.: 08/818,843

[22] Filed: Mar. 14, 1997

[51] Int. Cl.[6] ..... A47C 27/04; F16F 3/00

[52] U.S. Cl. ..... 267/103; 267/91; 5/248

[58] Field of Search ..... 267/91, 103, 107; 5/248, 249, 256, 474, 475

[56] References Cited

U.S. PATENT DOCUMENTS

| | | | |
|---|---|---|---|
| 1,732,588 | 10/1929 | Pittoni . | |
| 3,370,619 | 2/1968 | Docker . | |
| 4,488,712 | 12/1984 | Higgins | 267/91 |
| 4,510,635 | 4/1985 | Woffendin | 267/103 |
| 4,664,361 | 5/1987 | Sasaki | 267/103 |
| 4,766,625 | 8/1988 | Yates et al. | 5/248 |
| 4,771,494 | 9/1988 | Zapletal et al. | 5/475 |
| 4,790,038 | 12/1988 | Ikeda | 267/91 |
| 4,867,423 | 9/1989 | Marsh | 267/91 |
| 4,905,333 | 3/1990 | Scott | 5/475 |
| 4,942,636 | 7/1990 | Scott et al. | 5/247 |
| 4,960,267 | 10/1990 | Scott | 267/91 |
| 5,438,718 | 8/1995 | Kelly et al. | 5/477 |

*Primary Examiner*—Chris Schwartz
*Attorney, Agent, or Firm*—John Russell Uren

[57] ABSTRACT

A bed coil spring unit comprises a plurality of joined and interconnected spring cell units and a method of manufacturing the same. Each spring cell unit comprises a plurality of coil springs within long legs which long legs are used to form the coil springs. Each spring cell unit has a generally vertical axis. The coil springs which make up each spring cell unit are positioned symmetrically about the central axis. The plurality of coil springs in each spring cell unit conveniently numbers four(4).

8 Claims, 2 Drawing Sheets

BED COIL SPRING UNIT AND METHOD OF MAKING SAME

This invention relates to a bed coil spring unit and, more particularly, to a configuration for a plurality of spring cell units which make up the bed coil spring unit.

BACKGROUND OF THE INVENTION

There has been a long and continuing search for the optimum sleeping mattress. The search has taken many forms but, generally, it can be said that a principal comfort factor contributing to a coil spring type is the support which the coil spring unit used in the mattress may give to the user. If the support is comfortable and maintains the body in a condition which applies no unusual force, it will enhance the rest required by the user.

Elasticity of the bed coil spring unit is important. This is so since with greater elasticity, more constant support over the area of the body of the user being supported is obtained. To obtain such elasticity, rigid elements comprising the bed coil spring unit should be minimized.

Yet a further comfort factor is the symmetry of the bed coil spring unit. The prior art discloses various configurations of bed coil spring units. A typical one of such configurations is illustrated and disclosed in U.S. Pat. No. 4,960,267 entitled EDGE-REINFORCED SPRING BEDDING PRODUCT (Scott). Scott teaches a plurality of helicoils which extend transversely to the body of the user and which are separated a predetermined distance. The helicoils are used to connect adjacent cell units which together comprise the bed coil spring unit. So-called "long legs" extend transverse to the helicoils and define the opposite legs of the individual cell. A pair of coil springs are positioned within the cell with the circumference of each of the coil springs contacting and joined with the helicoils.

A problem with the bed coil spring unit according to the aforementioned Scott reference is that there is no symmetry in the bed coil spring unit within the individual cells. The coil springs are each located closer to one long leg thereby creating an upwardly directed force which acts on one side of the center axis and tends to create a moment acting outside the cell and on the body of a user. This moment has a tendency to move the user toward the side of the bed coil spring unit opposed from the side on which the coil springs are located which is not a comfort contributing factor.

SUMMARY OF THE INVENTION

According to one aspect of the invention, there is provided a bed coil spring unit having ends and sides for use with the reclining body of a user, said bed coil spring unit having a generally longitudinal axis extending between the ends of said unit and being equidistant from said sides of said unit, a plurality of helicoil members spaced a predetermined distance apart, a plurality of long legs extending between said helicoils and being generally parallel to said longitudinal axis of said bed coil spring unit and a plurality of coil springs positioned between said long legs and said helicoils, each of said coil springs having an axis and being positioned between said long legs and said helicoils to form a combination spring cell unit, each of said spring cell units having a central axis extending generally perpendicular to said helicoils and said long legs, said coil springs being located symmetrically about said central axis.

According to a further aspect of the invention, there is provided a method of constructing a bed coil spring unit comprising forming a generally rectangular spring cell unit and interconnecting said spring cell units to form said bed coil spring unit, each of said spring cell units comprising a generally vertical central axis and a plurality of coil springs, said coil springs being positioned symmetrically about said central axis.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
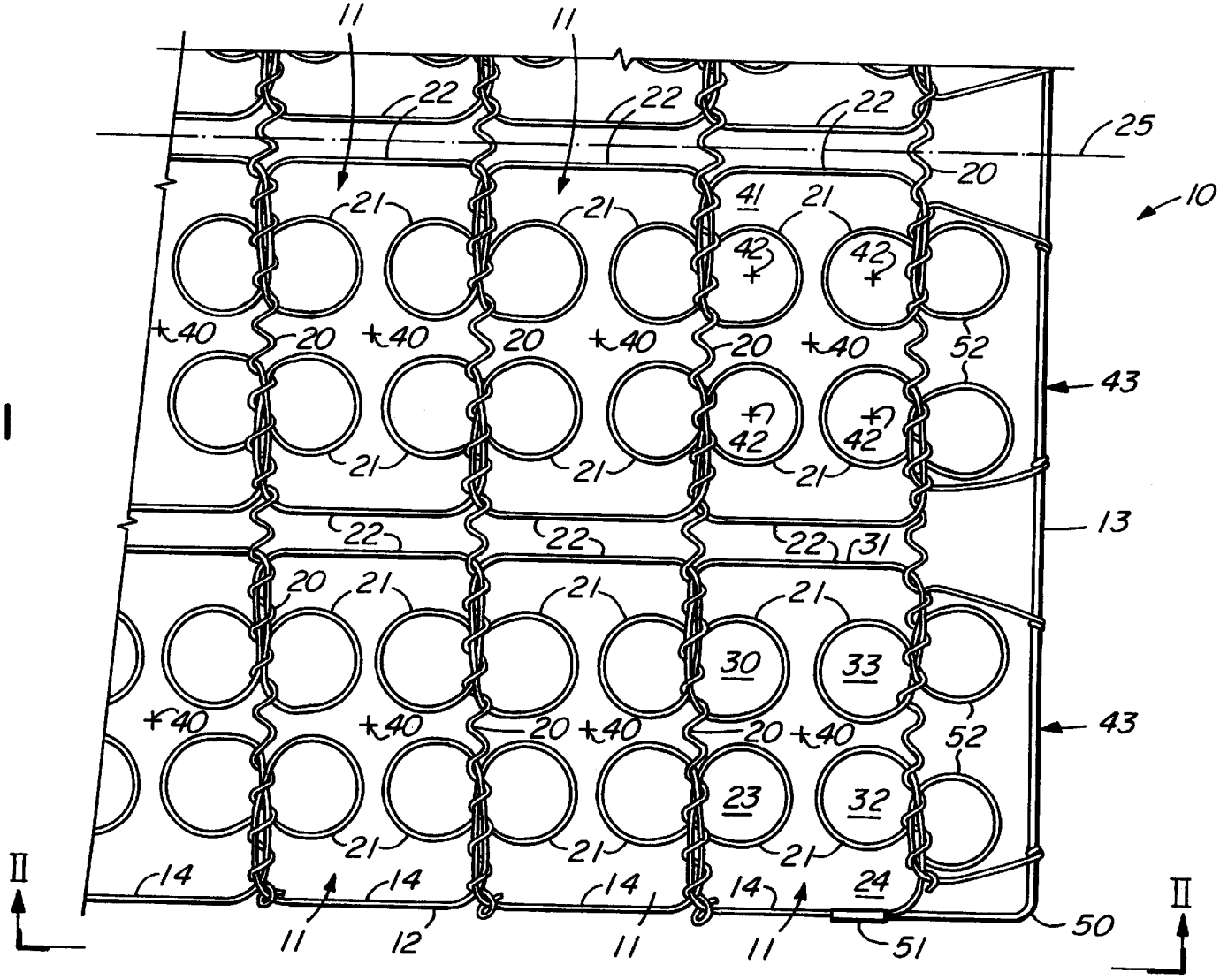
FIG. 1 is a partial plan view of one corner of the bed coil spring unit illustrating a plurality of spring cell units.

Referring now to the drawings, a bed coil spring unit intended to be incorporated within a sleeping mattress is illustrated generally at 10 in FIG. 1. It comprises a plurality of spring cell units, conveniently six(6), which are illustrated in their entirety, each cell being generally illustrated at 11. The spring cell units 11 extend between the sides 12 and ends 13 of the bed coil spring unit 10, it being understood FIG. 1 is a partial view of the bed coil spring unit only. Each of the opposed sides 12, only one of which is shown, is defined by a plurality of wire elements, commonly called "long legs" 14, which are joined together using a plurality of wire formed helicoils 20, which helicoils 20 are interwoven with the coil springs 21 as will be described. The helicoils 20 extend across the bed coil spring unit 10 between the sides 12 a predetermined distance apart and are intended to be generally perpendicular to the longitudinal axis 25 of the coil spring bedding unit 10, it being further understood that the bed coil spring unit 10 illustrated in FIG. 1 is a mirror image about the longitudinal axis 25.

In addition to the long legs 14 on the sides 12 of the bed coil spring unit 10, there are also "internal" long legs 22 formed on each side of the spring cell units 11 which internal long legs 22 are parallel to the side long legs 14. These internal long legs 22 together with the associated helicoils 20 generally form the rectangular spring cell unit 11.

Each spring cell unit 11 therefore includes two opposed long legs 22 and two opposed helicoils 20. The long legs 22 in adjacent spring cell units 11 run parallel to longitudinal axis 25 and are separated a predetermined distance, which distance may be calculated so as to conveniently maintain the overall size of the bed coil spring unit 10 and, as well, to increase or decrease the stiffness or elasticity of the unit 10 depending on the application. Also included within each spring cell unit 11 are four(4) coil springs 21. Each coil spring 21 is formed from the wire making up the adjacent and respective long leg 14, 22. For example, and with reference to spring cell unit 24 illustrated in FIG. 1, the lower lefthand coil 23 is formed from the wire making up long leg 14. The upper lefthand coil 30 is formed from the wire making up the long leg 22 forming the upper edge 31 of the cell 24 and the coils 32, 33 are formed from the wire making up the long legs 14, 22, respectively, the latter long leg 22 being the upper edge 31 of the cell 24, it being understood that the terms lower, upper, left hand, right hand, etc., are with reference to the figure being viewed and not with reference to the position of the bed coil spring unit 10 which is generally located in a horizontal position.

Each spring cell unit 11 has a centrally located axis 40 which extends generally perpendicular to the plane of FIG.

1, i.e., vertically when the coil spring bedding unit 10 is in its operating or horizontal position. The coil springs 21 are symmetrical about axis 40; that is, each spring axis 42 of each coil 21 in cell 41, for example, is equidistant from axis 40 of cell 41. Thus, the coil spring bedding unit 10 comprises a plurality of generally symmetrical spring cell units 11 which are connected together using helicoils 20 and which extend the length and width of the bed coil spring unit 10.

To provide support for the spring cell units 24, 41 on the end 13 of the bed coil spring unit 10, a frame generally illustrated at 43 is located. Frame 43 comprises steel upper end member 13, which is formed with a corner 50, the member 13 extending to and joining with the long leg 14 which makes up spring cell unit 24. The upper end member 13 is connected to long leg 14 using a tubular section 51 which is positioned over member 13 and the respective long leg 14 and then crimped with an appropriate tool to provide suitable connecting force.

A plurality of wire formed coils 52 extend downwardly from upper end member 13 and the end of the wire forming coils 52 is coiled about end member 13 as is illustrated, the wire also extending through the helicoil 20. The wire extending from the bottom of coil spring 52 forms a lower long leg 46 (FIG. 2) in the same configuration as member 13 and joins the lower helicoil 54 lying approximately one-half the distance between the upper helicoils 20 when viewed in plan.

Figure 2:
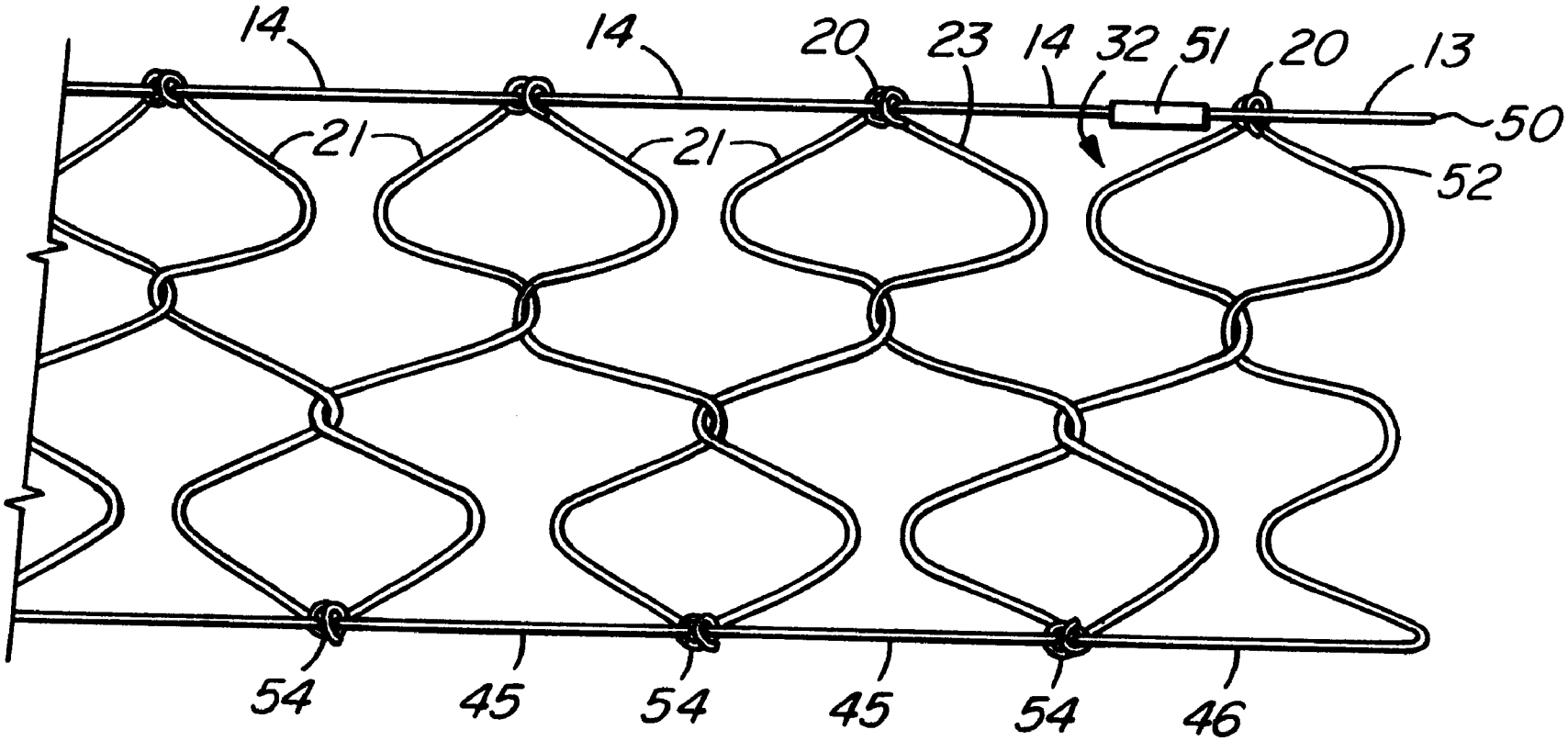
FIG. 2 is a partial side view of the bed coil spring unit of FIG. 1 taken along II—II of FIG. 1.

With reference to FIG. 2, it will be seen that the coils 21, 23, 32 and 52 are interconnected to provide strength as at positions 60, 61. The coils 21, 23, 32 and 52 connect with the lower helicoils 54 and extend into long legs 45 in a manner consistent with the configuration of the upper surface of the bed coil spring unit 10 illustrated in FIG. 1.

Operation

In operation, it will be seen that the formation of each spring cell unit 11 is symmetrical about its axis 40; that is, there are no moments created by the force on the coil springs 21 which extend outside the spring cell unit 11. Thus, there is no tendency to move the body of the user towards or away from the position wherein the body is positioned on the coil spring bedding unit 10. Likewise, it will be seen that the elasticity of the individual coils 21 is enhanced since the coil springs within each spring cell unit 11 at the top plane where the user rests are not attached to each other and more or less independently operate given the necessary restraints due to manufacturing considerations. Thus, the force exerted by the coils 21 depends on the downwardly directed force applied to the coils 21 by the body of the user positioned on the bed coil spring unit 10. Such elasticity provides enhanced support for the user and a more comfortable reclining position.

It is contemplated that the various dimensions between the long legs 14, 22, the helicoils 20, the long legs 22 in adjacent spring cell units 11, the coil springs 21 and the bed coil spring unit 10 are, of course, variable according to the various uses or applications to which the bed coil spring unit 10 may be particularly directed. These dimensions, including the diameter of the coil springs 21 and the distance of the axes 42 of the coil springs 21 from the central axis 40 of the spring cell units 11 can be optimized for the particular application.

While specific embodiments of the invention have been described, many modifications will readily occur to those skilled in the art to which the invention relates and the embodiments should be taken as illustrative of the invention only and not as limiting its scope as defined in accordance with the accompanying claims.

I claim:

1. A bed coil spring unit having ends and sides, said bed coil spring unit having a generally longitudinal axis extending between the ends of said unit and being equidistant from said sides of said unit, a plurality of helicoil coil members spaced a predetermined distance apart, a plurality of long legs extending between said helicoil coil members and being generally parallel to said longitudinal axis of said bed coil spring unit and a plurality of coil springs positioned between said long legs and said helicoil coil members, each of said coil springs having a spring axis and being positioned between said long legs and said helicoil coil members to form a combination spring cell unit, each of said spring cell units having a central axis located substantially in the center of said spring cell unit, said central axis extending generally perpendicular to said helicoil coil members and said long legs, said coil springs being located symmetrically about said central axis and between adjacent ones of said long legs, said coil springs numbering at least four.

2. A bed coil spring unit as in claim 1 wherein said long legs are formed from wire material, said coil springs being formed from said wire material of said long legs.

3. A bed coil spring unit as in claim 2 wherein said helicoils connect between adjacent ones of said spring cell units.

4. A bed coil spring unit as in claim 3 and further comprising an and member located on each end of said bed coil spring unit, said end member comprising an upper member and formed coils extending from said upper member, said formed coils being interconnected and constructed from wire material, said wire material being looped about said upper member.

5. A method of constructing a bed coil spring unit comprising forming a plurality of generally rectangular spring cell units, and interconnecting said spring cell units to form said bed coil spring unit, each of said spring cell units being defined at its perimeter by helicoil coil members and long legs, each of said spring cell units comprising a generally vertical central axis located substantially in the center of said spring cell unit and a plurality of coil springs, said plurality of coil springs being positioned symmetrically about said central axis and between adjacent ones of said helicoil coil members and said long legs, said plurality of coil springs numbering at least four (4).

6. A method of constructing a bed coil spring unit as in claim 5 wherein said spring cell units are interconnected using helicoil coil members.

7. A method of constructing a bed coil spring unit as in claim 6 and further comprising connecting an upper member to said spring cell units on the opposed distant ends of said bed coil spring unit and positioning a plurality of formed coils extending from said upper end member, said formed coils comprising a wire material.

8. A method of constructing a bed coil spring unit as in claim 7 wherein said wire material of said formed coils is connected to said upper member.

* * * * *